US012644453B2

(12) United States Patent
Sundheim et al.

(10) Patent No.: US 12,644,453 B2
(45) Date of Patent: Jun. 2, 2026

(54) VACUUM PUMP WITH OIL DRIP SHUTOFF

(71) Applicant: Gregory S. Sundheim, Englewood, CO (US)

(72) Inventors: Gregory S. Sundheim, Englewood, CO (US); Thomas C. Shoemaker, Englewood, CO (US); Brett W. Renck, Englewood, CO (US)

(73) Assignee: Gregory S. Sundheim, Englewood, CO (US)

( * ) Notice: Subject to any disclaimer, the term of this patent is extended or adjusted under 35 U.S.C. 154(b) by 0 days.

(21) Appl. No.: 18/895,889

(22) Filed: Sep. 25, 2024

(65) Prior Publication Data

US 2026/0085686 A1 Mar. 26, 2026

(51) Int. Cl.
*F04C 15/00* (2006.01)
*F04C 15/06* (2006.01)

(52) U.S. Cl.
CPC ..... *F04C 15/0088* (2013.01); *F04C 15/06* (2013.01)

(58) Field of Classification Search
CPC ..... F04C 15/0088; F04C 15/06; F04C 15/00; F04C 29/12; F04C 29/028; F04C 2240/30; F04B 53/16; F04B 53/18; F04B 53/10; F04B 39/02
See application file for complete search history.

(56) References Cited

U.S. PATENT DOCUMENTS 5,080,132 A 1/1992 Manz et al.
5,224,525 A 7/1993 Weichel
6,190,149 B1 * 2/2001 Richman ..... F04C 29/025 418/94
6,474,115 B1 * 11/2002 Preston ..... D06F 43/02 68/140
7,674,096 B2 * 3/2010 Sundheim ..... F04C 29/005 417/234
8,651,828 B2 * 2/2014 Sundheim ..... F04B 37/14 417/313
9,080,569 B2 * 7/2015 Sundheim ..... F04C 23/006
10,837,446 B2 * 11/2020 Hong ..... F04C 29/026
(Continued)

OTHER PUBLICATIONS

Fieldpiece Vacuum Pump With RunQuick Oil Change System Operator's Manual, pp. 1-18, copyrighted 2021; v06 downloaded Jul. 19, 2021.

(Continued)

*Primary Examiner* — Dapinder Singh
(74) *Attorney, Agent, or Firm* — Cochran Freund & Young LLC

(57) ABSTRACT

A vacuum pump assembly has a removable container for lubricating oil with a valve assembly to minimize drips while the oil container is removed. The valve assembly has an oil drain valve and an oil inlet valve controlling the flow of oil into and from the container, respectively. The valve assembly includes an adapter for removably attaching it to the port of the container. A bellows is compressed by attachment of the oil container to the adapter thereby opening both valves. The bellows expands when the oil container is removed from the adapter to close the valves. For example, the oil drain valve is actuated by movement of the bellows and the oil inlet valve is actuated by a first magnet. A second magnet moves with the bellows and controls the position of the first magnet to regulate operation of the oil inlet valve.

21 Claims, 11 Drawing Sheets

(56) References Cited

U.S. PATENT DOCUMENTS

| | | | | |
|---|---|---|---|---|
| 11,506,207 | B1 * | 11/2022 | Sundheim | F04C 25/02 |
| 2008/0124237 | A1 * | 5/2008 | Viken | F04C 14/08<br>418/142 |
| 2024/0110566 | A1 | 4/2024 | Hong | |

OTHER PUBLICATIONS

International Search Report, PCT/US2025/038851, Sep. 22, 2025.

* cited by examiner

VACUUM PUMP WITH OIL DRIP SHUTOFF

BACKGROUND OF THE INVENTION

Field of the Invention

This invention relates to the field of vacuum pumps and more particularly to the field of such pumps for use in servicing air conditioning and refrigeration systems.

Discussion of the Background

Rotary vane vacuum pumps are widely used in the servicing of air conditioning and refrigerant systems to draw down a relatively deep vacuum before the system is recharged. In a typical servicing procedure, the refrigerant of the system is first recovered and the unit opened to the atmosphere for repairs. Thereafter and prior to recharging it, the air and any residual moisture must be pulled out of the system, otherwise its performance will be adversely affected. More specifically, any air and moisture left in the system will interfere with the refrigerant's thermal cycle causing erratic and inefficient performance. Additionally, any residual air and moisture can cause undesirable chemical reactions within the system components and form ice crystals within the system contributing to accelerated component failures.

Most such vacuum pumps are submerged or at least partially submerged in a surrounding sump of oil. The oil sump provides a supply of oil for lubricating and sealing the rotating vanes inside the pump allowing the pump to draw a deep vacuum. The exterior oil sump about the operating pump also serves to cool it. Such arrangements typically feed the oil from the sump into the interior of the pump along a path or paths adjacent one or more of the pump bearings. The oil is then redistributed by rotational forces to the vanes and inner perimeter of the pump cylinder thereby providing lubrication and seals for the rotating parts. The oil level in these submerged sump designs must be kept above the inlet of the oil path to the pump's interior otherwise the pump will not receive a fresh and continuous supply of oil and the pump will not operate properly to pull a deep vacuum.

Such submerged or partially submerged designs are subject to oil being undesirably drawn or sucked from the sump back through the pump into the system being evacuated when the pump is shut off. This is the case whether the pump is intentionally turned off (e.g., by the operator) or unintentionally shut down (e.g., someone trips over the power cord to the pump or a circuit breaker is tripped). In such cases and if the air conditioning or refrigeration system being evacuated is not isolated from the pump, the vacuum in the system as indicated above will draw or suck oil from the sump backwards through the pump and into the system until there is finally a break to atmosphere somewhere. At this point, oil is undesirably in the air conditioning or refrigeration system and the system should be cleaned of this oil before proceeding, involving additional time and expense. The pump is also undesirably filled with incompressible oil which can result in damage to the pump parts and their alignment upon restarting. Further, the hoses connecting the pump and system being evacuated are usually filled with oil and disconnecting them typically creates a messy flow of oil in the immediate service area.

To address these draw or suck back problems, many pump manufacturers install a ball or other check valve arrangement on the input line to the pump from the system being evacuated. However, the ball or similar structure is an obstruction to the flow and can significantly reduce the flow rate from the system increasing the time and expense of the evacuation process. Further, as the evacuation becomes deeper and if the ball or similar member is spring biased toward its closed position, the spring force may overcome any small pressure differential on either side of the ball and prematurely close the check valve before the desired vacuum is drawn.

Many pump manufacturers employ a relatively effective way to address the draw back problem of oil into the system being evacuated by providing a manually operated isolation valve between the system and the pump. However, this relies on the operator remembering to close the valve once the desired vacuum has been drawn. More importantly, this approach does not prevent the draw back problem if the pump is unintentionally shut down (e.g., by someone tripping over the power cord to the pump or a circuit breaker is tripped). Further, neither this manual valve approach nor the check valve discussed above prevents oil from being drawn in and undesirably filling the pump. To address the pump problem, some manufacturers provide a manually operated venting valve to be activated once the pump has been isolated from the evacuated system. However, this again relies on the operator remembering to open the valve and does not prevent the draw back problem if the pump is unintentionally shut down.

The refrigerant in an air conditioning and refrigeration (AC/R) system works most efficiently when the refrigerant is 100% pure and with no contamination. The contamination may be in the form of water vapor, air or other gases, and compounds. The life and efficiency of the AC/R system can be severely negatively impacted by any contaminants left in it. To ensure that the AC/R system has minimal contamination, a deep vacuum (as deep as 500 or even 20 microns of mercury) is typically required to be pulled on the system to extract or draw out most of the system contaminants. Many manufacturers of equipment call out a specific vacuum level to be pulled and then held for a period of time to ensure that the system can be cleared of contaminants. Some even require doing this multiple times (e.g., three) while sweeping the system with clean, dry nitrogen between evacuations. In any event, the importance of having a clean, dry, and deeply evacuated system prior to charging or re-charging it with refrigerant cannot be overstated. Similarly, the ability to quickly change the oil without interrupting the evacuating operation of the vacuum pump is paramount. In smaller systems, this can amount to saving many hours and in larger systems, it may save days or even weeks of time.

With these and other problems in mind, the present invention was developed. In it, a pump design is provided that is not submerged in the sump oil and additionally has an automatic arrangement to safely break the vacuum in the pump and in the system being evacuated should the pump be intentionally or unintentionally shut down. Additionally, a quick oil change system is equipped with a valve assembly to provide an automatic oil drip shutoff when the lubricating oil container is detached.

SUMMARY OF THE INVENTION

This invention provides a vacuum pump assembly having a removable container for lubricating oil with a valve assembly to minimize drips while the oil container is removed. The valve assembly has an oil inlet valve (e.g., a ball valve) actuated by a first magnet to control the flow of oil through the oil inlet line to the vacuum pump, and an oil drain valve controlling the flow of oil into the container. The valve assembly also includes an adapter for removably attaching it to the port of the container. A bellows is compressed by attachment of the oil container to the adapter thereby opening the oil drain valve. The bellows expands when the oil container is removed from the adapter to close the oil drain valve. A second magnet moves with the bellows and controls the position of the first magnet to regulate operation of the oil inlet valve.

DETAILED DESCRIPTION OF THE INVENTION

Figure 1:
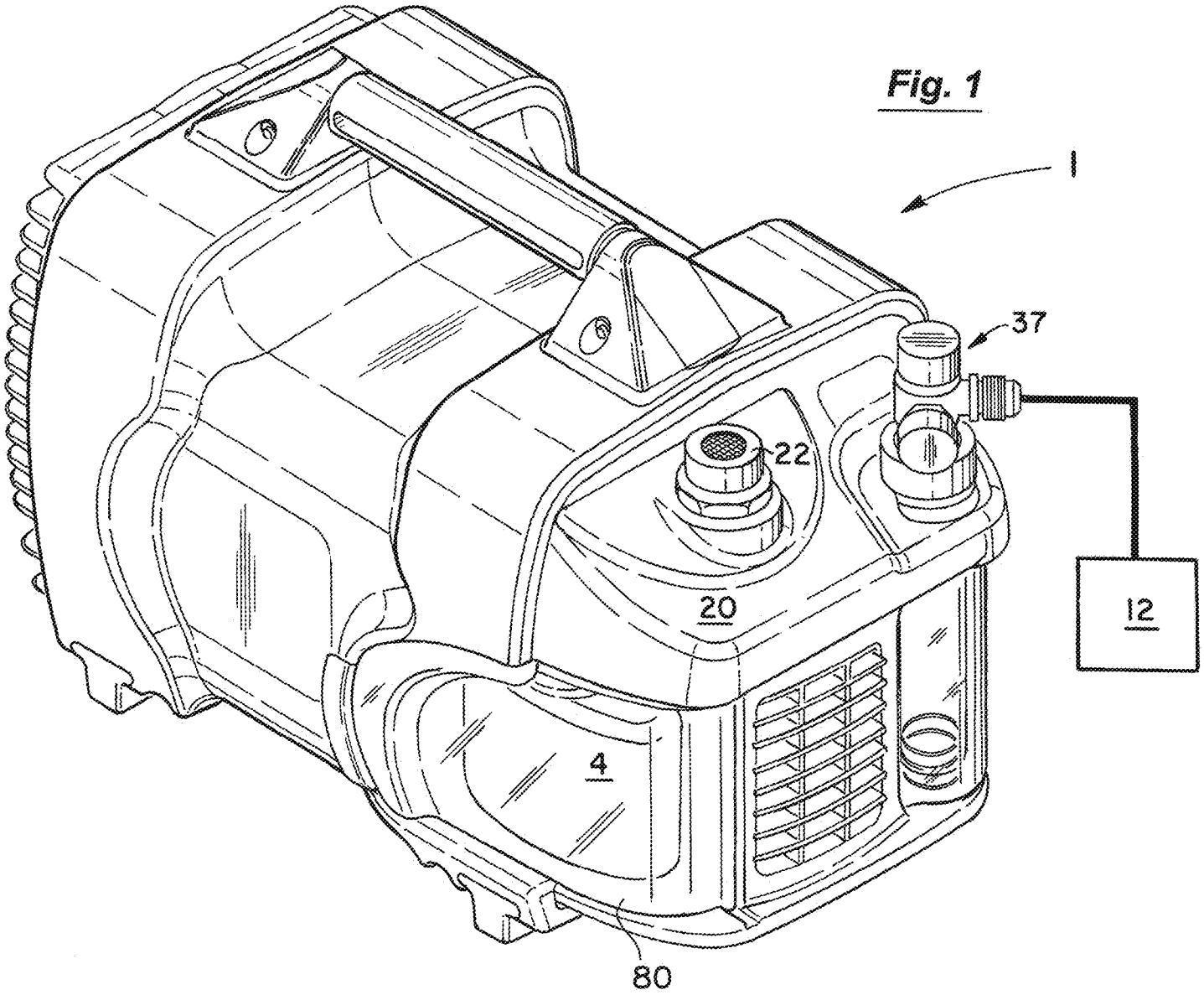
FIG. 1 is a perspective view of the rotary vane vacuum pump of the present invention.
Figure 2:
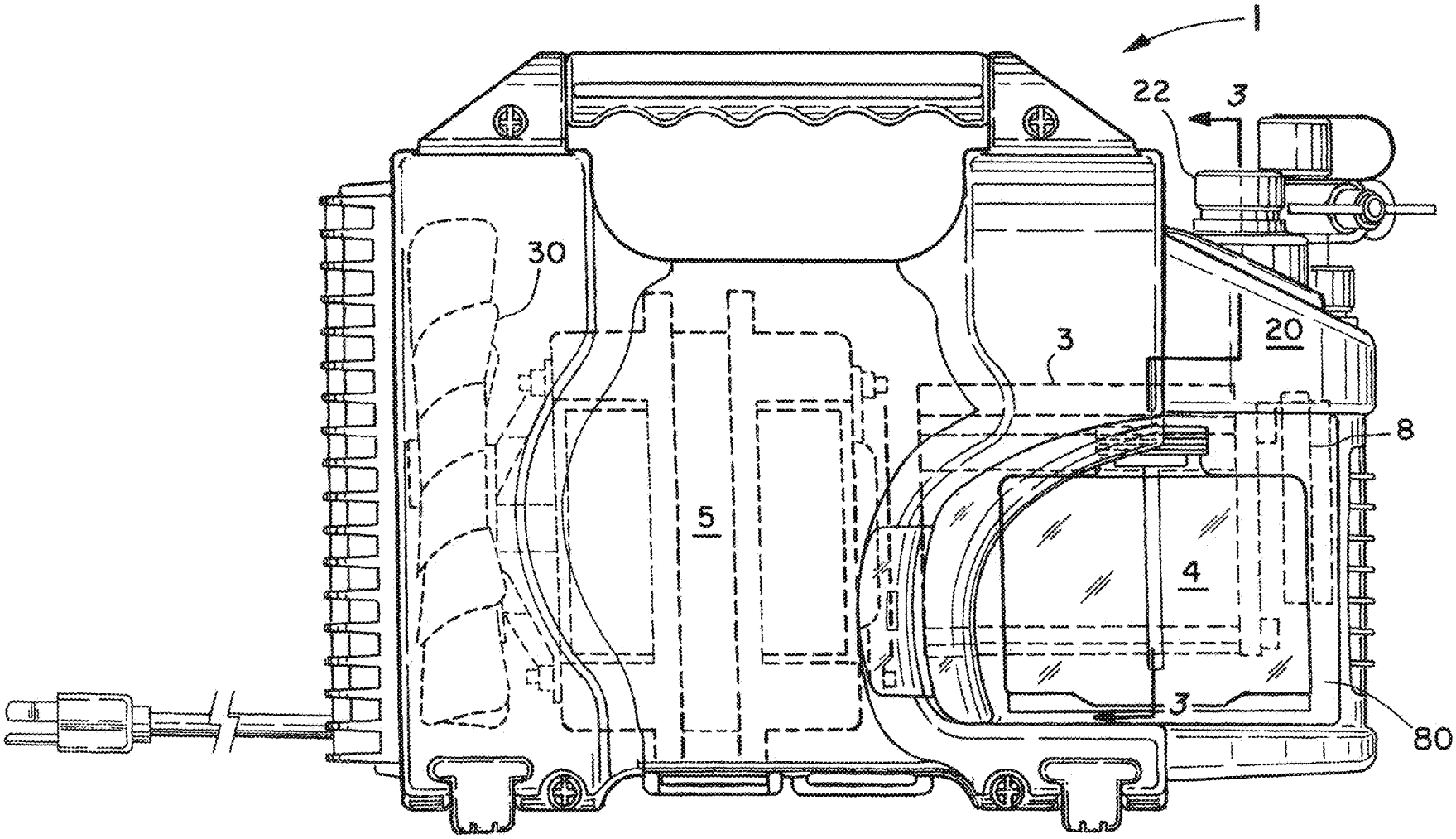
FIG. 2 is a side view of the vacuum pump.
Figure 3:
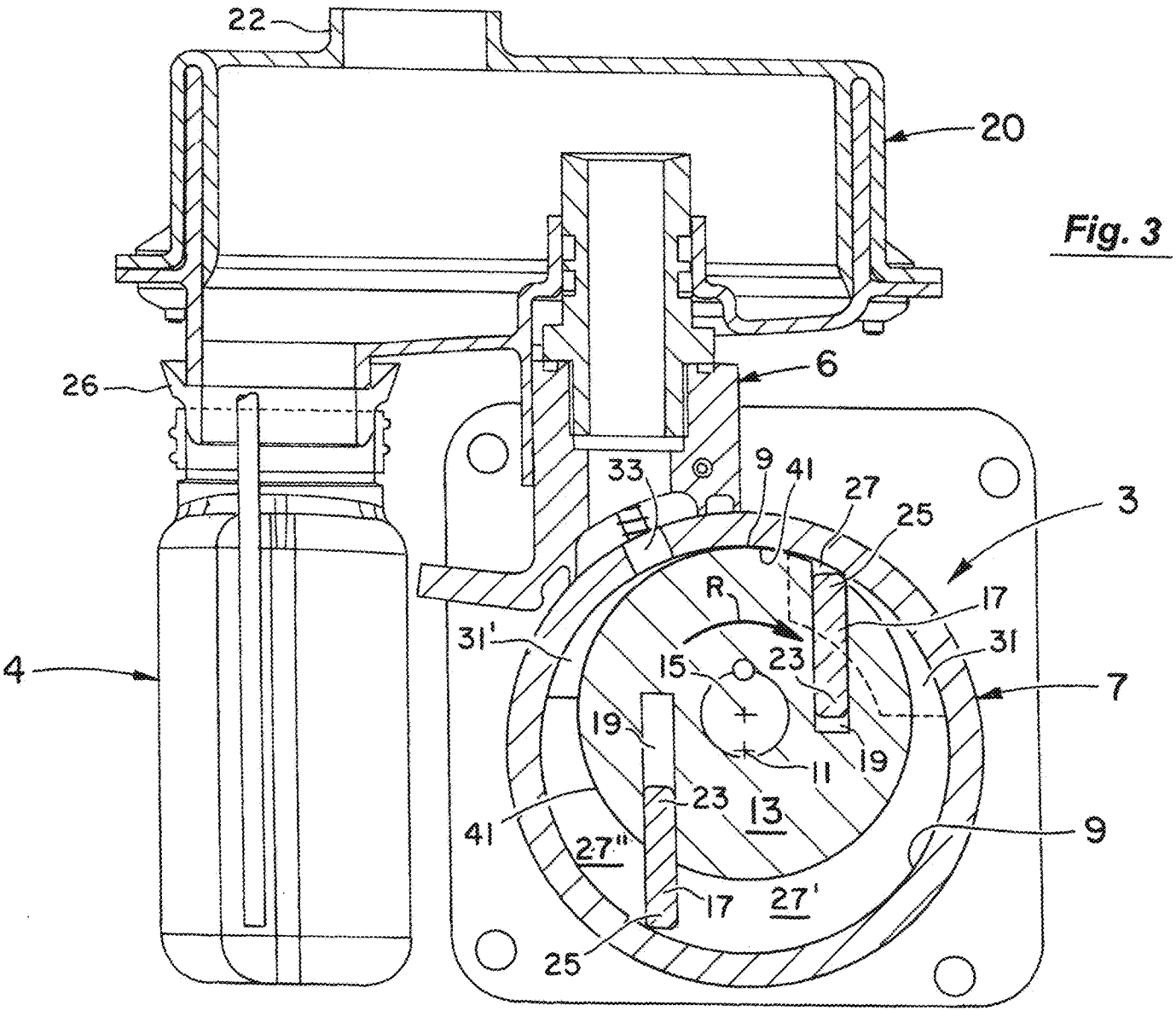
FIG. 3 is a view taken generally along line 3-3 of FIG. 2.

As illustrated in FIGS. 1 and 2, the pump 1 of the present invention is a portable unit and includes a rotary vane, vacuum pump 3 (see FIGS. 2 and 3) driven by the electric motor 5 (FIG. 2). The vane pump 3 as best seen in FIG. 3 (which is a view taken generally along line 3-3 of FIG. 2) has a housing 7 with an inner surface 9 extending about the axis 11 to define in part a bore. The rotor 13 of the pump 1 is mounted within the bore (FIG. 3) for rotation about the axis 15. The axis 15 as illustrated is offset from and substantially parallel to the housing axis 11. The rotor 13 also includes at least two vanes 17 mounted for sliding movement within the respective slots 19.

In operation, the motor 5 of FIG. 2 rotates the rotor 13 in a first direction 21 (clockwise in FIG. 3) about the axis 15 within the bore of the housing 7. In this regard, each vane 17 of the rotor 13 has an inner 23 and outer 25 edge portion. The outer edge portions 25 contact the inner surface 9 of the housing 7 due to the centrifugal forces developed as the rotor 13 is rotated by the motor 5 about the axis 15. The vanes 17 then progressively separate the bore of the housing 7 into a plurality of chambers 27, 27', and 27" as shown.

Figure 4:
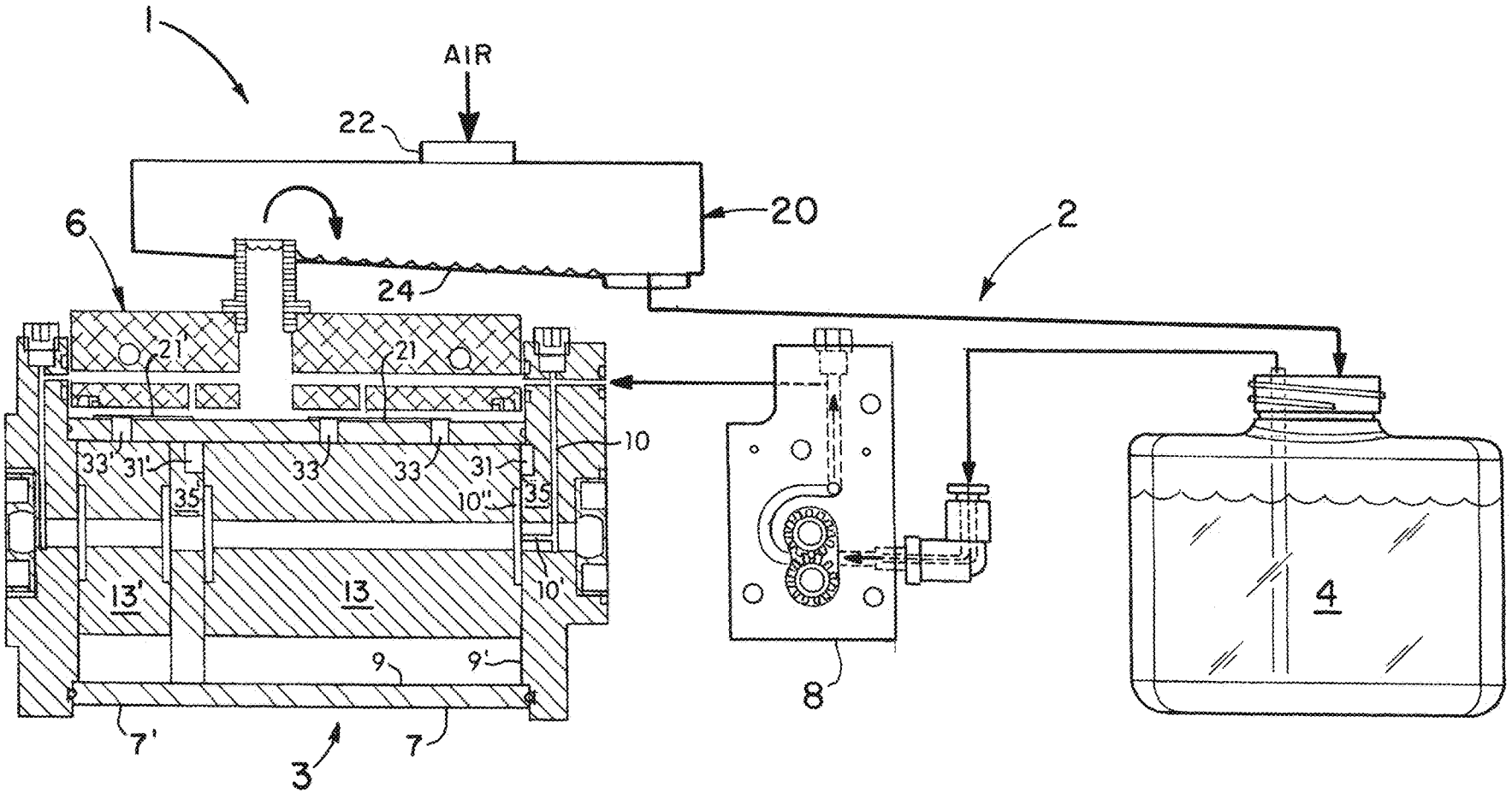
FIG. 4 is a schematic illustration of the lubricating oil system of the vacuum pump including its oil inlet and oil return arrangements.

The housing 7 of FIG. 3 further includes at least one inlet passage 31 in the inner surface 9' (see also FIG. 4) of the housing end wall 35 and at least one outlet passage 33 through the inner surface 9 (FIGS. 3 and 4). The passages 31 and 33 are respectively in fluid communication with the bore of the housing 7 with the inlet passage 31 connected to the system or unit 12 to be evacuated via the inlet porting at 37 of FIG. 1. It is noted that although the inlet and outlet passages 31, 33 are shown in FIGS. 3 and 4 in the respective surfaces 9 and 9', these passages could be ported in any of the surfaces forming the housing bore. In any event, the rotor 13 as shown in FIG. 3 is substantially cylindrical with a substantially cylindrical outer surface 41 extending about the rotor axis 15 and abutting the inner surface 9 of the housing 7 at an upper location between the inlet and outlet passages 31, 33.

The pump 1 of the present invention as schematically shown in FIG. 4 has a lubricating oil system 2 which includes an inlet oil arrangement and an oil return arrangement. As explained in more detail below, the oil inlet arrangement supplies oil from the primary oil container 4 (FIG. 4) to the vane pump 3 and to the secondary oil container 6. The oil return arrangement then delivers oil back from the vane pump 3 and secondary oil container 6 to the primary container 4, all while the containers 4, 6 are open to atmosphere and at ambient pressure.

More specifically, the oil inlet arrangement of the system 2 as illustrated in FIG. 4 includes the primary oil reservoir container 4 (e.g., 8 ounces), the much smaller secondary oil reservoir oil container 6 (e.g., 0.5 ounces), and an oil pump mechanism 8 between the primary and secondary containers 4, 6. The oil pump mechanism 8 is preferably a positive displacement one such as the illustrated gear pump. The pump mechanism 8 serves to move oil from the primary container 4 to the secondary container 6 with both containers 4, 6 being open to atmosphere as shown and for all practical purposes at ambient pressure.

Figure 6:
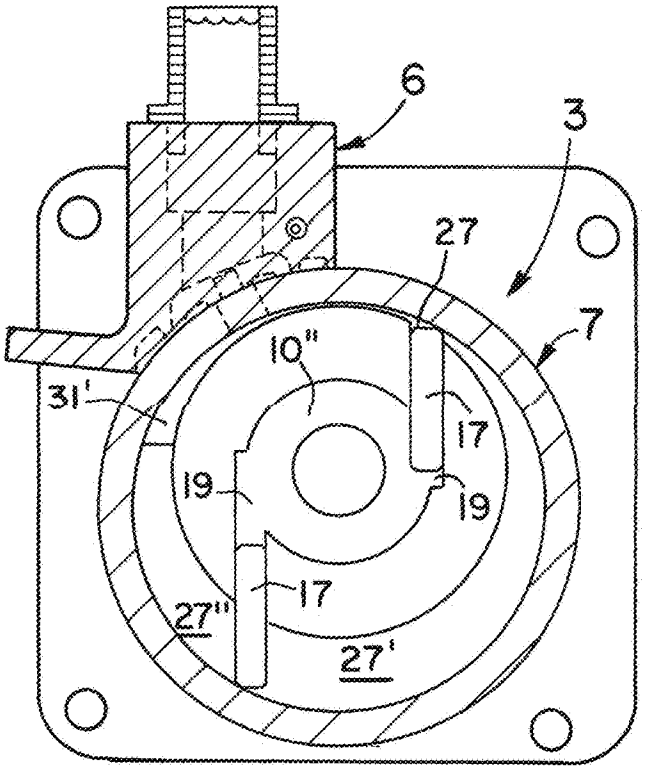
FIG. 6 is a view taken along line 6-6 of FIG. 5.
Figure 5:
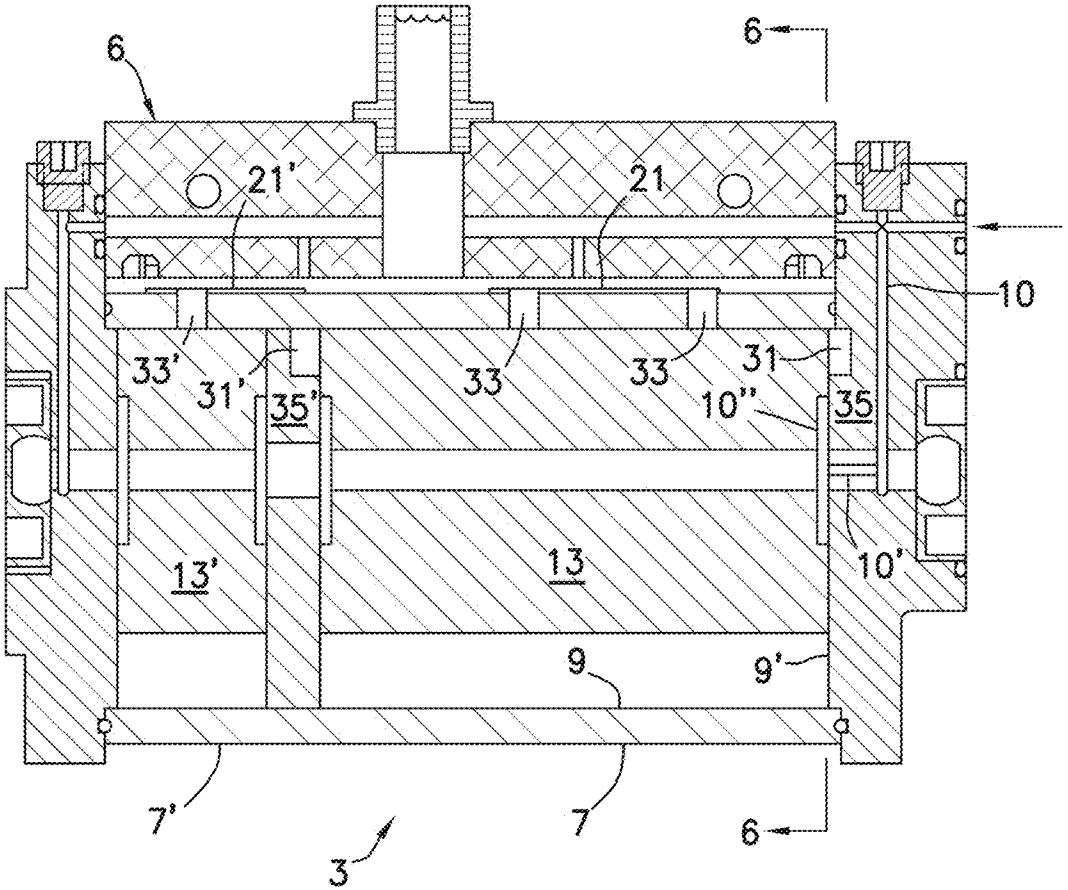
FIG. 5 is an enlarged view of the oil inlet arrangement supplying oil from the primary oil container to the vacuum pump and to the secondary oil container.

The oil inlet arrangement supplies oil from the primary container 4 downstream of the oil pump mechanism 8 through the illustrated path or passage 10, 10', 10" (see FIGS. 4 and 5) to at least one chamber (e.g., 27' in FIG. 6) and preferably to all of the vane pump chambers 27, 27', and 27" of FIG. 6. It is noted that the path portion 10 is preferably immediately adjacent the secondary oil container 6 but can be part of the container 6 if desired. In any event and in supplying oil to the vane pump 3, the evacuated chambers (e.g., 27') are at pressure less than ambient. Consequently, the evacuated chambers draw or suck oil along the path or passage 10, 10', 10" (FIG. 5) through the vane slots 19 (FIG. 6) past the vanes 17 and into the evacuated bore of the housing 7. The oil inlet path or passage 10, 10', 10", 19 in this regard is in fluid communication with the secondary oil container 6 (FIGS. 4 and 5) and the secondary container 6 in turn is open to the atmosphere (FIG. 4) and at ambient pressure.

Figure 7:
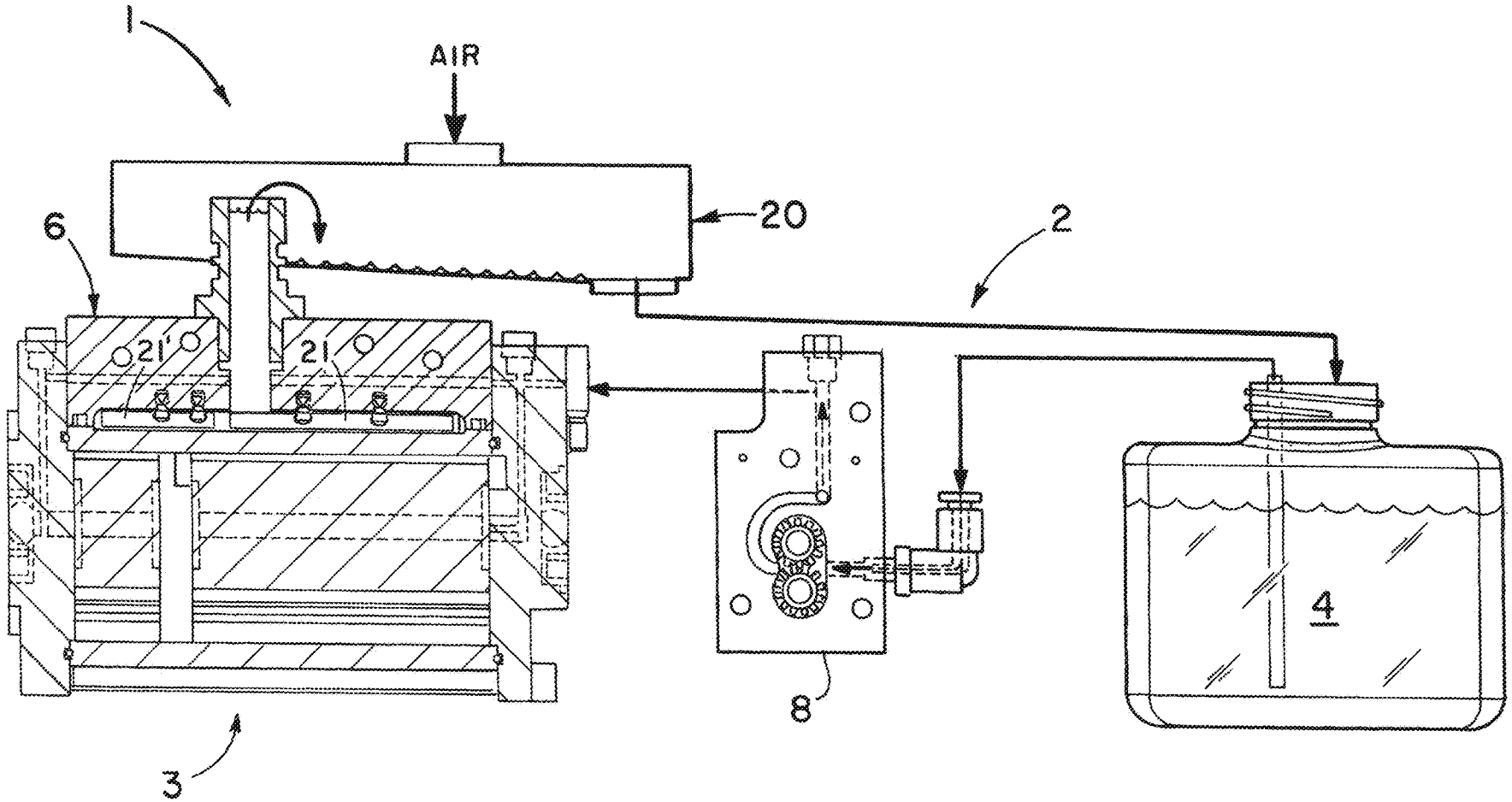
FIGS. 7 and 8 are views similar to FIG. 4 showing the reed or flapper valves in their closed (FIG. 7) and open (FIG. 8) positions.
Figure 8:
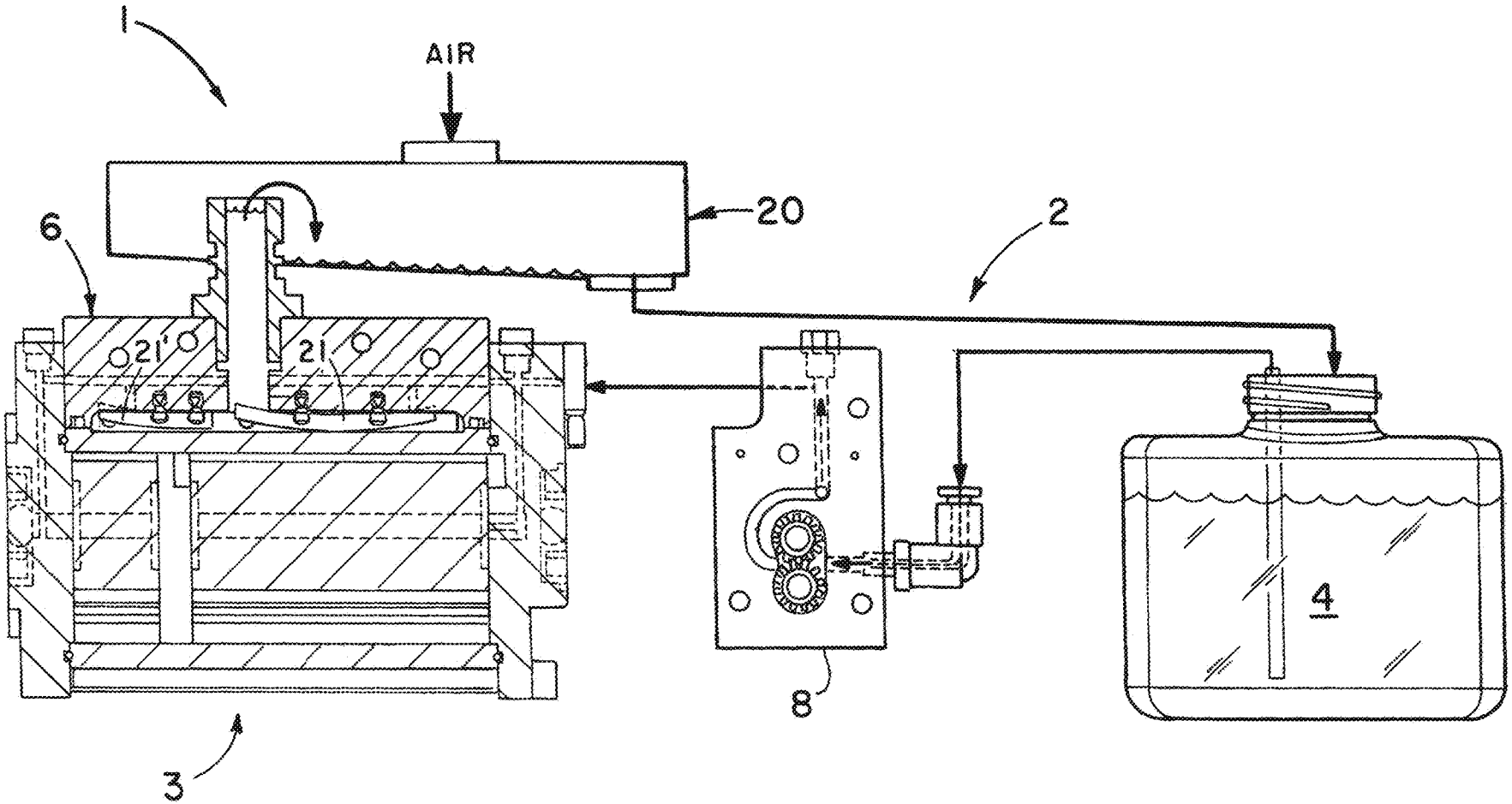

The oil return arrangement of the lubricating oil system 2 as indicated above delivers the oil back from the vane pump 3 and secondary oil container 6 to the primary oil container 4. In this regard, the oil in the bore of the housing 7 of the vane pump 3 supplied through the path or passage 10, 10', 10", 19 as previously discussed exits the vane pump 3 (FIG. 4) through the outlet passages 33. The oil then passes by the reed or flapper valve 21 into the secondary container 6. The reed valve 21 is spring biased toward its closed position of FIGS. 4 and 7 and selectively opens (FIG. 8) and closes (FIG. 7) the outlet passages 33. The reed or similar valve 21 essentially vibrates or flaps in response to the pressure waves and volumes of gas and oil moving out of the housing bore past the valve 21. In doing so, the discharged mixture of gas and oil gurgles or bubbles up through the oil in the secondary container 6 (FIG. 4) into the separating chamber 20. The separating chamber 20 is part of the oil return arrangement to the primary oil container 4 and is open to atmosphere at 22 and at ambient pressure. In the chamber 20, the gas from the vane pump 3 that discharged into the oil of the secondary container 6 separates from the oil and discharges to the atmosphere through the opening 22. The separated oil in turn preferably returns by gravity along the downwardly-inclined surface 24 of the chamber 20 and flows back into the primary oil container 4. The circuit of the oil is then repeated until the motor 5 is shut down either intentionally (e.g., by the operator) or unintentionally (e.g., by someone tripping over the power cord to the pump or a circuit breaker is tripped).

Upon the motor 5 being shut down and the rotor 13 ceasing to be driven, the vacuum in the bore of the housing 7 (e.g., less than ambient and as deep as 500 or even 20 microns of mercury) is automatically broken and vented to atmosphere. The venting is done from the secondary container 6 (FIG. 4) which is open to atmosphere and at ambient pressure via the oil inlet path or passage 10, 10', 10", 19 to the housing bore. In doing so, it is noted that a small amount of oil in the secondary oil container 6 and the path or passage 10, 10', 10", 19 may be sucked into the housing bore with the incoming, venting air. Some of this oil may also be sucked from the housing bore into the system or unit being evacuated if it still connected to the vane pump 3. However, the amount of oil that may be drawn in is essentially only what is in the venting path of the secondary oil container 6 and portions 10, 10', 10", 19. This amount is so small (e.g., 0.5 ounces or slightly more) compared to the volume (e.g., 2.5 ounces or more) of the chambers 27, 27', 27" as not to create a problem in the vane pump 3 or the unit being evacuated. In contrast, current designs may undesirably draw oil into the pump chambers and into the unit if it still connected until the vacuum is broken somewhere. By that time, the vane pump may be completely filled with incompressible oil and the unit contaminated with oil. The contaminated unit must then be thoroughly cleaned of oil involving considerable time and expense. Additionally, the vane pump must also be drained of the excess oil before restarting otherwise it may be severely damaged.

The vane pump 3 of the present invention can be a single or multiple stage pump. In a multiple stage design as in FIG. 4, the rotor 13' of the housing 7' of the second stage operates essentially the same as the rotor 13 of the first stage. The oil in this regard for the second stage can be drawn into the bore of the second stage via a path or passage similar to 10, 10', 10", 19 of the first stage. However, in the preferred embodiment of FIG. 4, the oil enters the housing 7' of the second stage entrained in the gas and oil being discharged from the first stage. That is, the mixed gas and oil in the first stage normally will exit through the discharge passages 33 of FIG. 4 past the reed valve 21 (see also FIG. 8) until a first vacuum is drawn (e.g., 500 microns of mercury). The reed valve 21 will then typically close or be drawn shut and the complete discharge from the first stage will be drawn through the inlet port 31'(FIG. 4) in the end wall 35' into the second stage. A deeper vacuum (e.g., 20-50 microns of mercury) is then drawn by the second stage with the gas and oil mixture exiting through the discharge port 33' of FIG. 4 past the reed valve 21'. In such a multiple stage design and should the motor 5 be shut down intentionally or not, the reed valve 21' like the reed valve 21 of the first stage will be sucked down and closed. The second stage will then vent through its inlet port 31' from the first stage and to atmosphere via the path or passage 19, 10", 10', 10 and the secondary oil reservoir 6 as discussed above.

The automatic vacuum breaking arrangement of the present invention can then serve to safely vent single or multiple stage pumps. In doing so, the primary oil reservoir container 4 and secondary oil reservoir container 6 can at all times be open to the atmosphere and at ambient pressure.

The primary oil reservoir container 4 is preferably connected at 26 in FIG. 3 to the chamber 20 and can easily be manually removed. The primary container 4 can preferably hold virtually all of the oil (e.g., 8 ounces) in the oil lubricating system 2 and can be used to change out the oil whether or not the vane pump 3 is operating. That is, a quick change of the system's oil can be made by replacing the original container 4 with a fresh one full of clean oil. If the vane pump 3 is still operating, there is normally enough oil remaining in the system to keep it safely running during the change. The primary container 4 in this regard is preferably made of substantially clear, rigid material (e.g., plastic) and positioned in the front of the main body of the pump 1 (FIGS. 1 and 2) behind a clear door so the condition of the oil can be visually monitored and a change made as needed.

In the preferred embodiment, the primary oil reservoir 4 is essentially the entire sump (e.g., 8 ounces) for the oil of the system and can easily be removed from the main body of the pump 1. The remainder of the system then contains only a relatively small fraction of oil compared to the primary container 4. The secondary container 6, for example, may contain about 1/10 or less (e.g., 1/16 or 0.5 fluid ounces) of the volume of oil in the primary container 4. The residual oil in the rest of the system may be even less. Because the pump is not submerged in the sump oil, the various parts of the main body including the vane pump 3 and motor 5 can be air cooled (e.g., by the fan 30 of FIG. 2). This in contrast to pumps that are completely or partially submerged in the sump oil for cooling. The current design thus results in a much simpler design with less need for expensive sealing throughout the system. It also avoids many potential problems of submerged pumps such as the draw or suck back problem discussed above. Submerged pumps in particular may undesirably draw oil from the sump not only along flow lines but also between any and all abutting parts when the motor is shut down. Further in regard to the cooling fan 30, it like the vane pump 3 and pump mechanism 8 can be conveniently driven from the common motor 5 directly (e.g., 1700 RPM) or through gearing if desired.

Figure 9:
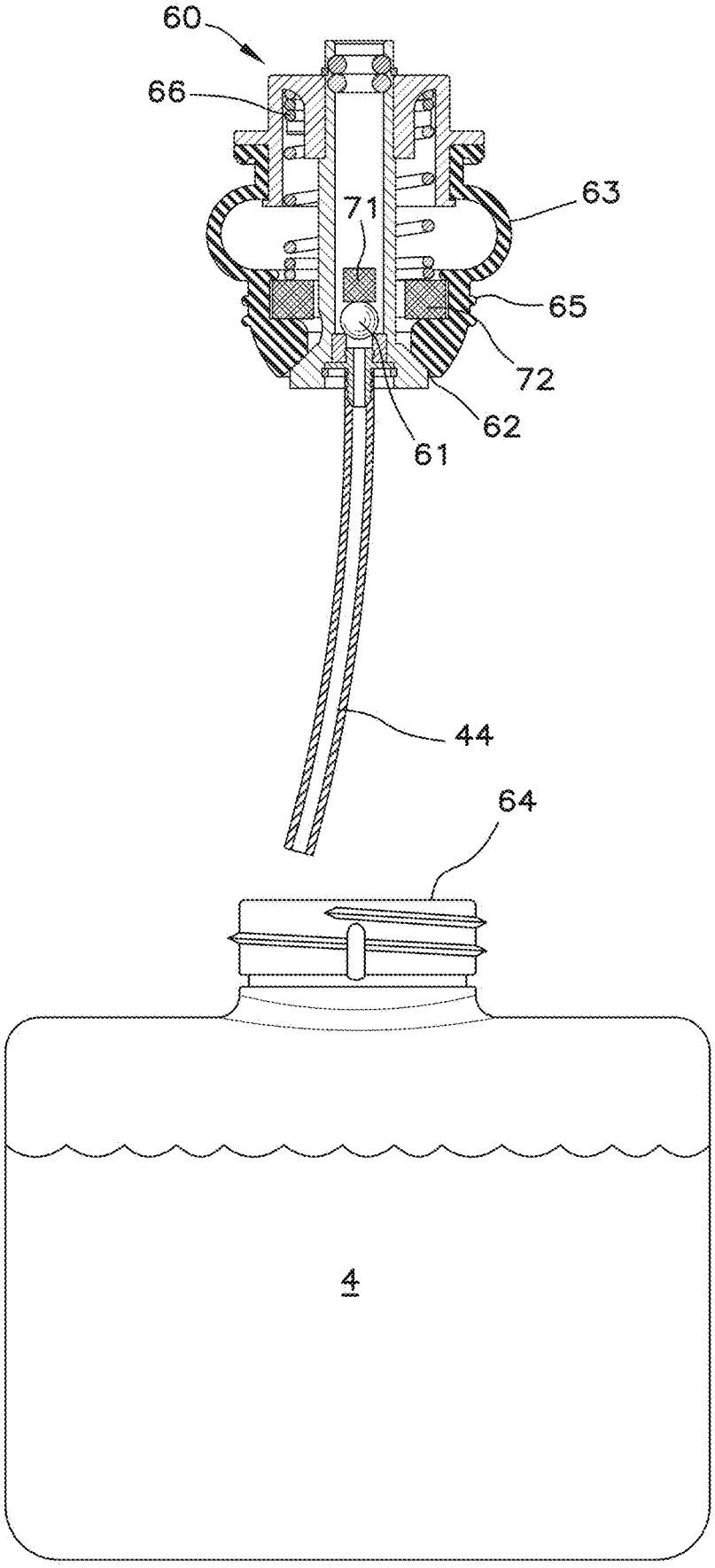
FIG. 9 is a side cross-sectional view of the valve assembly 60 being attached to an oil container 4 with the oil drain valve 62 and oil inlet valve 61 closed to prevent drips.
Figure 10:
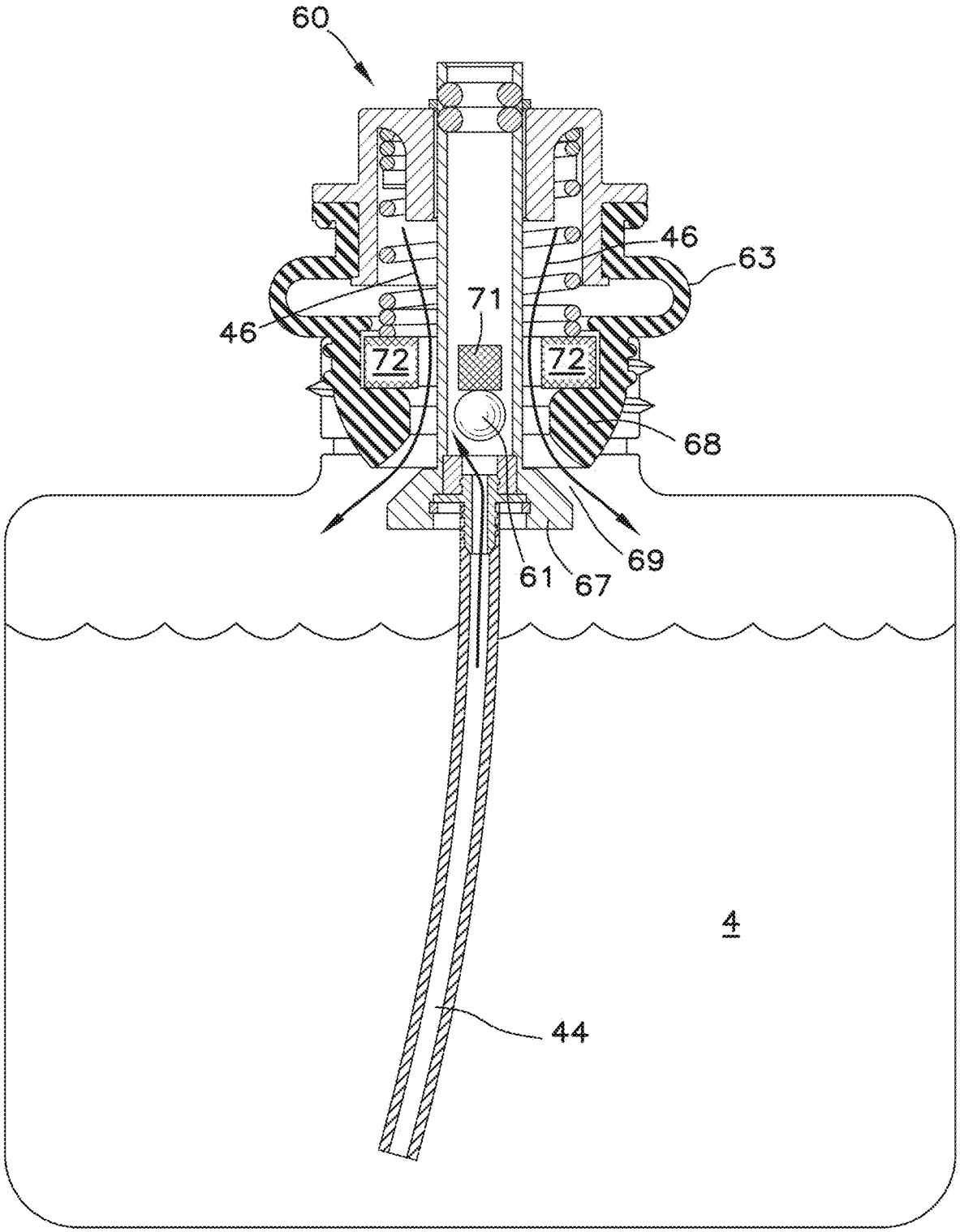
FIG. 10 is a side cross-sectional view of the valve assembly 60 after it has been attached to the oil container with the oil drain valve 62 and oil inlet valve 61 open to allow circulation of lubricating oil to the vacuum pump.
Figure 11:
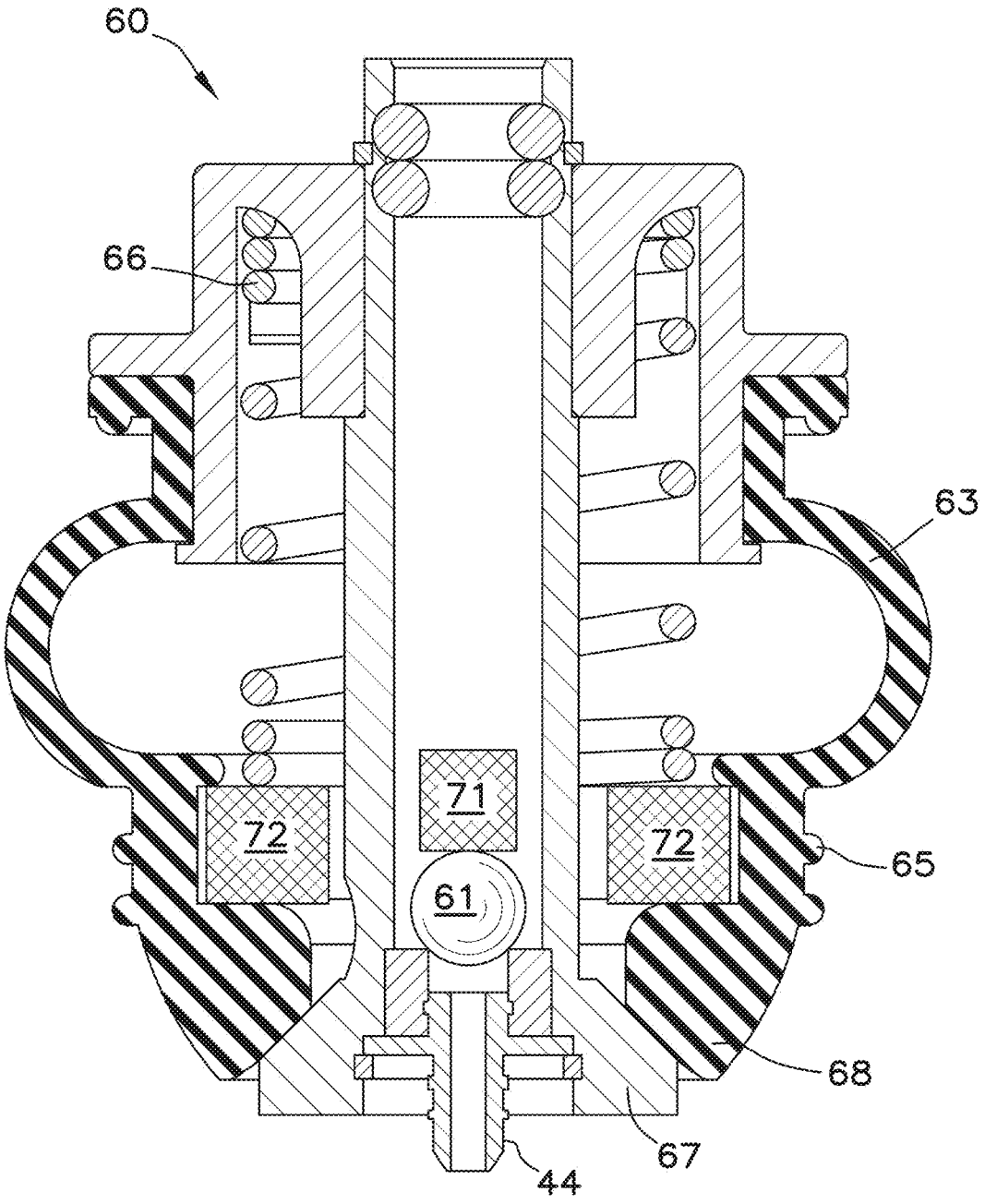
FIG. 11 is an enlarged cross-sectional view of the detached valve assembly 60 with the oil drain valve and oil inlet valve closed.
Figure 12:
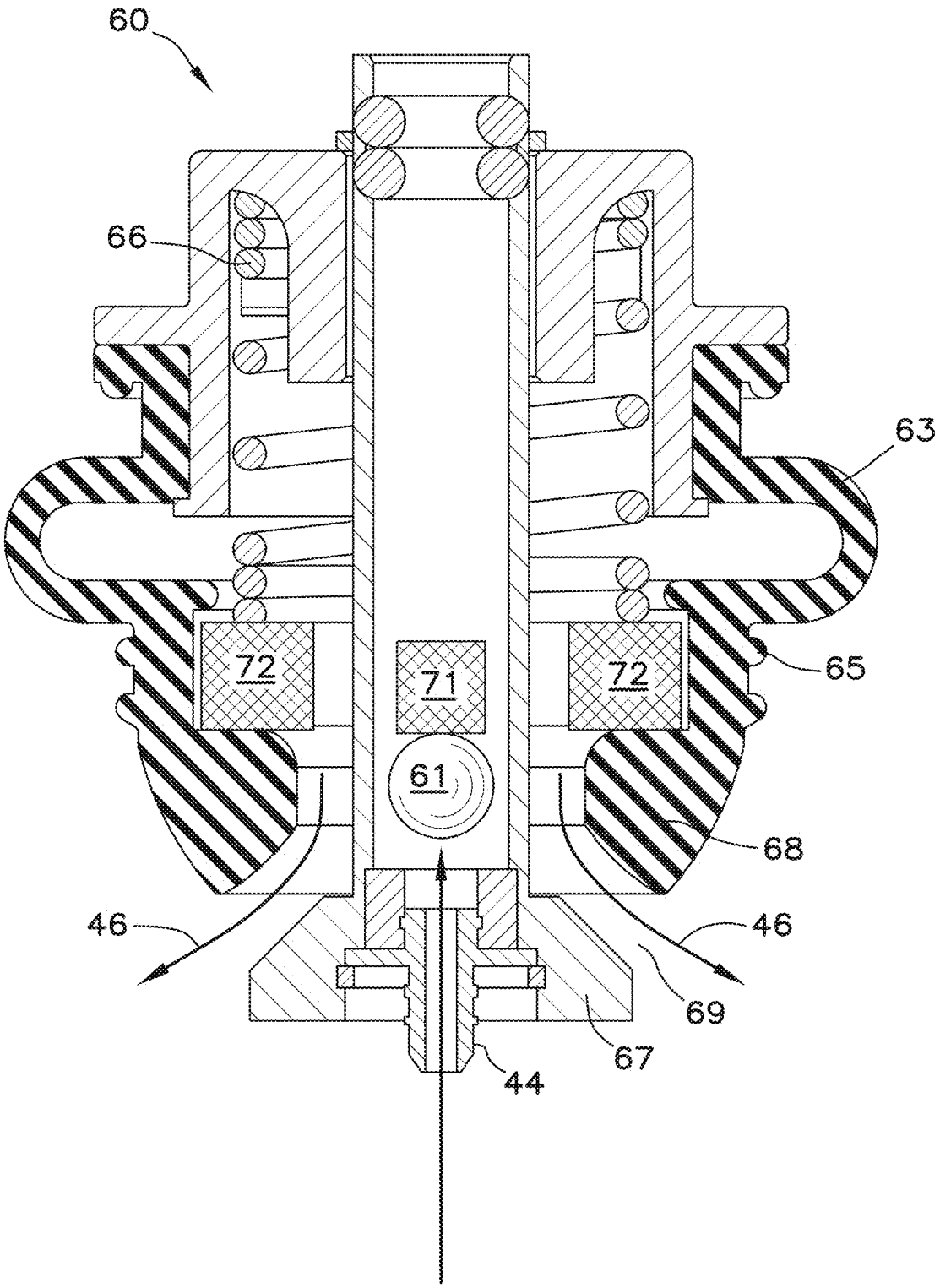
FIG. 12 is an enlarged cross-sectional view of the valve assembly 60 with the oil drain valve and oil inlet valve open.

FIG. 9-12 show an embodiment of the present invention that includes a valve assembly 60 for minimizing oil drips when the oil container 4 is removed from the vacuum pump. More specifically, this valve assembly 60 automatically closes an oil inlet valve 61 in the oil inlet line 44 and an oil drain valve 62 in the oil return line 46 to prevent oil drips when the oil container 4 is detached from the vacuum pump, as illustrated in FIGS. 9 and 11. The valve assembly 60 also automatically opens these valves 61, 62 while the oil container to attached to allow circulation of lubricating oil to the vacuum pump, as shown in FIGS. 10 and 12.

The valve assembly 60 has an adapter 65 at its base for removably attaching the valve assembly 60 to the port 64 of the oil container 4. Preferably, the adapter 65 fits into the port 64 and creates a seal with the port 64 to minimize the risk of oil escaping from the container. Alternatively, the adapter 65 can be a cap that fits over the port 64.

The valve assembly 60 also includes an oil inlet valve 61 controlling the flow of lubricating oil from the oil container 4 to the oil inlet line 44 of the pump. For example, the oil inlet valve 61 can be a conventional ball valve, as shown in FIGS. 9-12. A first magnet 71 actuates this oil inlet valve 61 between open and closed states to control the flow of oil from the oil container through the oil inlet line 44, as will be described below in greater detail. In one embodiment of the present invention, the oil inlet valve passes vertically through the central portion of the valve assembly as shown in FIGS. 9-12

An oil drain valve 62 controls the flow of lubricating oil from the pump through the oil return line 46 into the oil container 4. As shown in FIGS. 9-12, the oil drain valve 62 can have an annular inner valve member 67 surrounding the oil inlet valve 61, and an annular outer valve member 68 surrounding the inner valve member 67. An annular oil drain channel 69 is defined between these inner and outer valve members 67 and 68.

A cylindrical bellows 63 extending upward from the upper portion of outer valve member 68 of the oil drain valve 62 is compressed by attachment of the oil container 4 to the adapter 65. The bellows 63 expands downward by default when the oil container 4 is detached from the adapter 65.

This bellows 63 thereby allows the entire valve assembly 60 to be compressed to a degree by attachment of the oil container 4. In particular, attachment of the oil container 4 pushes upward on the outer valve member 68 of the oil drain valve 62 and causes it to move upward relative to the inner valve member 67. This relative movement opens the lower orifice of the oil drain channel 69 to allow lubricating oil to drain into the oil container 4 while the oil container 4 is attached to the adapter 65. In contrast, when the oil container 4 is detached, the default expanded state of the bellows pushes the outer valve member 68 of the oil drain valve 62 downward against the inner valve member 67 to close the oil drain channel 69 and thereby prevent oil drips.

Thus, to summarize, the outer valve member 68 of the oil drain valve 62 moves downward to close the oil drain channel 69 when the oil container 4 is detached from the adapter 65 and the bellows 63 is allowed to expand. The outer valve member 68 moves upward to open the oil drain channel 69 when the oil container 4 is attached to the adapter 65 and the bellows 63 is compressed Optionally, the valve assembly 60 can also include a spring 66 exerting a biasing force to help hold the bellows 63 in its default expanded state. This spring 66 exerts a force to expand the bellows 63 and close the oil drain valve 62 and oil inlet valve 61 when the oil container 4 is removed from the adapter 65.

The bellows 63 also controls vertical movement of a second magnet 72, which slides vertically between two positions based on the state of the bellows 63. Preferably, the second magnet 72 is generally annular and surrounds the oil inlet valve 61 in close proximity to the first magnet 71. This proximity causes the first magnet 71 to follow the movements of the second magnet 72. The second magnet 72 thereby controls operation of the oil inlet valve 61 so that the oil inlet valve 61 opens and closes corresponding to the compressed or expanded state of the bellows 63, respectively. In particular, the second magnet 72 moves the first magnet 71 downward to close the oil inlet valve 61 when the oil container 4 is removed from the adapter 65 and the bellows 63 expands, and moves the first magnet 71 upward to open the oil inlet valve 61 when the oil container 4 is attached to the adapter 65 and the bellows 63 is compressed. Thus, the oil inlet valve 61 and oil drain valve 62 operate in tandem based on whether the oil container 4 is attached to the adapter 65.

It should be noted that a single magnet would be sufficient, assuming the other element is made of a ferrous material suitable for providing magnetic coupling between these elements. The claims in this application should be construed to include this embodiment of the present invention. In addition, the first magnet 71 could be the ball in the oil inlet valve 61. This would enable the second magnet 72 to directly control the state of the oil inlet valve 61.

A recess 80 can be formed in the external housing of the pump for receiving and removably retaining the oil container 4. In this embodiment, the valve assembly 60 is mounted in the upper portion of the recess 80. The adapter 65 of the valve assembly 60 extends downward into this recess 80 so that it can engage the port 64 of the oil container 4 as the oil container 4 is placed into the recess 80. The recess 80 also has a shelf or bottom edge to support the bottom of the oil container 4 and hold it in removable engagement with the adapter 65 of the valve assembly 60. Insertion of the oil container 4 into the recess 80 and insertion of the adapter 65 into the port 64 of the oil container 4 compresses the valve assembly 60 and bellows 63 to open the valves 61, 62. Removal of the oil container 4 from the adapter 65 allows the bellows 63 to expand and thereby close both valves 61, 62 as previously discussed.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims. In particular, it is noted that the word substantially is utilized herein to represent the inherent degree of uncertainty that may be attributed to any quantitative comparison, value, measurement or other representation. This term is also utilized herein to represent the degree by which a quantitative representation may vary from a stated reference without resulting in a change in the basic function of the subject matter involved.

We claim:

1. A vacuum pump assembly for evacuating an air conditioning and refrigeration system to a pressure substantially below ambient atmospheric pressure, said vacuum pump comprising:

a vacuum pump having a housing with an interior bore and an oil inlet passage and an oil outlet passage through the housing in respective fluid communication with the bore of the housing;

a removable oil container having a port;

an oil inlet line supplying oil from the oil container to the vacuum pump;

an oil drain line returning oil from the vacuum pump to the oil container; and a valve assembly having:

(a) an oil inlet valve controlling the flow of oil from the oil container through the oil inlet line;

(b) an oil drain valve controlling the flow of oil through the oil drain line into the oil container; and (c) an adapter for removably attaching the port of the oil container to the valve assembly, wherein attachment of the oil container to the adapter opens the valves and removal of the oil container from the adapter closes the valves.

2. The vacuum pump assembly of claim 1 wherein the adapter is insertable into the port of the oil container and forms a seal with the port of the oil container.

3. The vacuum pump assembly of claim 1 wherein the valve assembly further comprises a bellows compressed by attachment of the oil container to the adapter to thereby open the valves; said bellows expanding when the oil container is removed from the adapter to thereby close the valves.

4. The vacuum pump assembly of claim 3 wherein the oil drain valve further comprises:

an annular inner valve member surrounding the oil inlet valve; and an annular outer valve member surrounding the inner valve member, wherein said outer valve member moves upward when the bellows is compressed to open the oil drain valve, and moves downward when the bellows expands to close the oil drain valve.

5. The vacuum pump assembly of claim 3 further comprising:

a first magnet actuating one of the oil inlet valve and the oil drain valve; and a second magnet moving with the bellows and controlling the position of the first magnet to open the other of oil inlet valve and oil drain valve when the oil container is attached to the adapter and to close the other of the oil inlet valve and oil drain valve when the oil container is removed from the adapter.

6. The vacuum pump assembly of claim 5 wherein the second magnet is annular and surrounds the oil inlet valve.

7. The vacuum pump assembly of claim 3 further comprising a recess for receiving and removably retaining the oil container, whereby insertion of the oil container into the recess and insertion of the adapter into the port of the oil container compresses the valve assembly and bellows to open the valves, and removal of the oil container from the adapter allows the bellows to expand and thereby close the valves.

8. A vacuum pump assembly for evacuating an air conditioning and refrigeration system to a pressure substantially below ambient atmospheric pressure, said vacuum pump comprising:

a vacuum pump having a housing with an interior bore and an oil inlet passage and an oil outlet passage through the housing in respective fluid communication with the bore of the housing;

a removable oil container having a port;

an oil inlet line supplying oil from the oil container to the vacuum pump;

an oil drain line returning oil from the vacuum pump to the oil container; and a valve assembly having:

(a) an oil inlet valve actuated by a first magnet to control the flow of oil from the oil container through the oil inlet line;

(b) an oil drain valve controlling the flow of oil through the oil drain line into the oil container;

(c) an adapter for removably attaching the port of the oil container to the valve assembly;

(d) a bellows compressed by attachment of the oil container to the adapter thereby opening the oil drain valve; said bellows expanding when the oil container is removed from the adapter to close the oil drain valve; and (e) a second magnet moving with the bellows and controlling the position of the first magnet to open the oil inlet valve when the oil container is attached to the adapter and to close the oil inlet valve when the oil container is removed from the adapter.

9. The vacuum pump assembly of claim 8 wherein the adapter is insertable into the port of the oil container and forms a seal with the port of the oil container.

10. The vacuum pump assembly of claim 8 wherein the oil drain valve further comprises:

an annular inner valve member surrounding the oil inlet valve; and an annular outer valve member surrounding the inner valve member, wherein said outer valve member moves upward when the bellows is compressed to open the oil drain valve, and moves downward when the bellows expands to close the oil drain valve.

11. The vacuum pump assembly of claim 8 wherein the oil inlet valve further comprises a ball valve actuated by the first magnet.

12. The vacuum pump assembly of claim 8 further comprising a spring exerting a force to expand the bellows and close the oil drain valve and oil inlet valve when the oil container is removed from the adapter.

13. The vacuum pump assembly of claim 8 wherein the second magnet is annular and surrounds the oil inlet valve.

14. The vacuum pump assembly of claim 8 wherein the oil drain valve is annular and surrounds the oil inlet valve.

15. The vacuum pump assembly of claim 8 further comprising a recess for receiving and removably retaining the oil container, whereby insertion of the oil container into the recess and insertion of the adapter into the port of the oil container compresses the valve assembly and bellows to open the valves, and removal of the oil container from the adapter allows the bellows to expand and thereby close the valves.

16. A vacuum pump assembly for evacuating an air conditioning and refrigeration system to a pressure substantially below ambient atmospheric pressure, said vacuum pump comprising:

a vacuum pump having a housing with an interior bore and an oil inlet passage and an oil outlet passage through the housing in respective fluid communication with the bore of the housing;

a removable oil container having a port;

an oil inlet line supplying oil from the oil container to the vacuum pump;

an oil drain line returning oil from the vacuum pump to the oil container; and a valve assembly having:

(a) an oil inlet valve actuated by a first magnet to control the flow of oil from the oil container through the oil inlet line;

(b) an oil drain valve having:

(i) an annular inner valve member surrounding the oil inlet valve; and (ii) an annular outer valve member surrounding the inner valve member and separated by an oil drain channel controlling the flow of oil through the oil drain line into the oil container;

(c) an adapter for removable insertion into the port of the oil container to attach the valve assembly to the oil container, wherein insertion of the adapter into the port of the oil container compresses the valve assembly and removal of the oil container from the adapter causes the valve assembly to expand;

(d) a bellows compressed by attachment of the oil container to the adapter, and expanding downward when the oil container is removed from the adapter; and (e) a second magnet moving with the bellows and controlling the position of the first magnet;

wherein said outer valve member of the oil drain valve moves downward to close the oil drain channel when the oil container is detached from the adapter and the bellows expands, and moves upward to open the oil drain channel when the oil container is attached to the adapter and the bellows is compressed; and wherein said second magnet moves the first magnet downward to close the oil inlet valve when the oil container is removed from the adapter and the bellows expands, and moves the first magnet upward to open the oil inlet valve when the oil container is attached to the adapter and the bellows is compressed.

17. The vacuum pump assembly of claim 16 further comprising a recess for receiving and removably retaining the oil container, whereby insertion of the oil container into the recess and insertion of the adapter into the port of the oil container compresses the valve assembly and bellows to open the valves, and removal of the oil container from the adapter allows the bellows to expand and thereby close the valves.

18. The vacuum pump assembly of claim 16 wherein the adapter forms a seal with the port of the oil container.

19. The vacuum pump assembly of claim 16 wherein the oil inlet valve further comprises a ball valve actuated by the first magnet.

20. The vacuum pump assembly of claim 16 further comprising a spring exerting a force to expand the bellows and close the oil drain valve and oil inlet valve when the oil container is removed from the adapter.

21. The vacuum pump assembly of claim 16 wherein the second magnet is annular and surrounds the oil inlet valve.

* * * * *